US011480118B2

(12) United States Patent
Yudanov

(10) Patent No.: US 11,480,118 B2
(45) Date of Patent: Oct. 25, 2022

(54) SYSTEM FOR VENTILATION OF A CRANKCASE

(71) Applicant: VOLVO TRUCK CORPORATION, Gothenburg (SE)

(72) Inventor: Sergi Yudanov, Västra Frölunda (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 16/496,793

(22) PCT Filed: May 16, 2017

(86) PCT No.: PCT/EP2017/061729
§ 371 (c)(1),
(2) Date: Sep. 23, 2019

(87) PCT Pub. No.: WO2018/210409
PCT Pub. Date: Nov. 22, 2018

(65) Prior Publication Data
US 2020/0378322 A1 Dec. 3, 2020

(51) Int. Cl.
*F02D 41/00* (2006.01)
*F01M 11/10* (2006.01)
(Continued)

(52) U.S. Cl.
CPC ..... *F02D 41/0025* (2013.01); *F01M 11/10* (2013.01); *F01M 13/0011* (2013.01);
(Continued)

(58) Field of Classification Search
CPC ..... F02D 41/0025; F02D 41/22; F01M 11/10; F01M 13/0011; F02M 25/06
See application file for complete search history.

(56) References Cited

U.S. PATENT DOCUMENTS 9,765,721 B2 * 9/2017 Nakano ..... F01M 13/028
10,408,143 B2 * 9/2019 Dudar ..... F01M 13/022
(Continued)

FOREIGN PATENT DOCUMENTS

CN 104047674 A 9/2014
CN 104781513 A 7/2015
(Continued)

OTHER PUBLICATIONS

International Search Report and Written Opinion dated Feb. 1, 2018, issued in International Application No. PCT/EP2017/061729.
(Continued)

*Primary Examiner* — Kevin A Lathers
(74) *Attorney, Agent, or Firm* — Venable LLP; Jeffri A. Kaminski

(57) ABSTRACT

The invention provides a system for ventilation of a crankcase (217) of an internal combustion engine, the system comprising—an air inlet guide (203, 212) adapted to guide air to at least one cylinder (220) of the engine,—a closed circuit conduit (209) for guiding crankcase gas from the crankcase (217) to the air inlet guide (203, 212),—wherein the system comprises gas detection means (2181, 2182, 2183) positioned in the air inlet guide (203, 212), for detecting crankcase gas in the air inlet guide.

32 Claims, 5 Drawing Sheets

(51) Int. Cl.

| | |
|---|---|
| ***F01M 13/00*** | (2006.01) |
| ***F02D 41/22*** | (2006.01) |
| ***F02M 25/06*** | (2016.01) |
| ***F02M 35/10*** | (2006.01) |

(52) U.S. Cl.
CPC ..... *F02D 41/22* (2013.01); *F02M 25/06* (2013.01); *F02M 35/10222* (2013.01); *F02M 35/10373* (2013.01)

(56) References Cited

U.S. PATENT DOCUMENTS

| | | | | |
|---|---|---|---|---|
| 2008/0058994 | A1 | 3/2008 | Tsuda | |
| 2011/0023850 | A1* | 2/2011 | Karlovsky | F01M 13/00 123/573 |
| 2011/0313642 | A1 | 12/2011 | Sano et al. | |
| 2015/0267633 | A1* | 9/2015 | Nakano | F02D 45/00 73/114.77 |
| 2015/0345349 | A1 | 12/2015 | Monros | |

FOREIGN PATENT DOCUMENTS

| | | | |
|---|---|---|---|
| CN | 105464746 | A | 4/2016 |
| CN | 106062328 | A | 10/2016 |
| DE | 102007050087 | B3 | 6/2009 |
| DE | 102014219822 | A1 | 3/2016 |
| DE | 102015007513 | A1 | 12/2016 |
| EP | 2431582 | A2 | 3/2012 |
| EP | 2937532 | A1 | 10/2015 |
| JP | H09189679 | A | 7/1997 |
| JP | H10339126 | A | 12/1998 |
| JP | 2011001909 | A | 1/2011 |
| JP | 2016130455 | A | 7/2016 |
| WO | 2007125242 | A1 | 11/2007 |
| WO | 2010147132 | A1 | 12/2010 |

OTHER PUBLICATIONS

European Office Action dated Feb. 7, 2022 in corresponding European Patent Application No. 17725206.1, 7 pages.
Chinese Office Action dated May 30, 2022 in corresponding Chinese Patent Application No. 201780089050.3, 18 pages.
China Office Action dated Sep. 29, 2021 in corresponding China Patent Application No. 201780089050.3, 9 pages.

* cited by examiner

SYSTEM FOR VENTILATION OF A CRANKCASE

TECHNICAL FIELD

The invention relates to a system for ventilation of a crankcase of an internal combustion engine, a method for controlling an internal combustion engine, a computer program, a computer readable medium, a control unit, and a vehicle.

The invention can be applied in heavy-duty vehicles, such as trucks, buses and construction equipment. Although the invention will be described with respect to a heavy-duty vehicle, the invention is not restricted to this particular vehicle, but may also be used in other vehicles such as working machines, and cars.

BACKGROUND

In an internal combustion engine, such as heavy duty vehicle diesel engine, there might be a risk of the engine entering a so called runaway condition, which, although rare, may seriously damage the engine. In such a condition the engine draws extra fuel from an unintended source, overspeeds, and may be destroyed by mechanical failure or seizure. The extra fuel, forming an undesired or unrequested introduction of hydrocarbon into the cylinders of the engine, may enter via the engine air intake system. The unrequested hydrocarbon may include, for example, hydrocarbon of fuel and engine oil. For example, a mixture of excess fuel and oil may be vented from the engine crankcase into the air intake via a crankcase ventilation system of the engine. The excess fuel and oil may enter the crankcase due to leakage from a fuel system (e.g. from pumps, injectors and connecting pipes), an oil leak in the seal of a turbocharger, or leakage from the cylinders into the crankcase. Further possible causes to engine runaway conditions include undesired oil or fuel leakage into the cylinders, which does not combust completely and gets re-introduced via an exhaust gas recirculation (EGR) path, and oil introduced at an air intake compressor through damaged seals in the compressor shaft.

In diesel engines using diesel oil fuel, leakage of fuel into the crankcase may be managed by a crankcase ventilation system based on the evaporation of the fuel from the warm oil in the crankcase. In a closed crankcase ventilation system gas, herein referred to a crankcase gas, from the crankcase is returned to engine air intake for combustion. The gas may have entered the crankcase in the form of so called blow-by gas passing the pistons during engine operation. However, when the fuel is volatile such as dimethyl ether (DME), a high leakage rate to the crankcase may provide correspondingly high evaporation rate, thus posing a risk of knocking combustion, backfiring and even a runaway of an engine with a closed crankcase ventilation system. Providing instead an open crankcase ventilation system provides as a result ventilating the vaporized fuel to the atmosphere, which may result in a safety hazard, increases the environmental burden and may not be allowed in some jurisdictions.

WO2010147132 discloses an example of a solution for handling blow-by gas. An engine is provided with a crankcase gas conduit which guides crankcase gas containing DME vapor into an air inlet of the engine. In addition, a release line is arranged to release the crankcase gas to the atmosphere. However, there is still a desire to further improve possibilities of effectively reducing risks caused by combustible blow-by gas and crankcase fuel vapor in engines.

SUMMARY

An object of the invention is to improve crankcase gas handling strategies in internal combustion engines.

The object is achieved by system according to claim 1. Thus, the invention provides a system for ventilation of a crankcase of an internal combustion engine, the system comprising

- an air inlet guide adapted to guide air to at least one cylinder of the engine,
- a closed circuit conduit for guiding crankcase gas from the crankcase to the air inlet guide,
- wherein the system comprises gas detection means positioned in the air inlet guide, for detecting crankcase gas in the air inlet guide.

The engine may be adapted to run on a variety of fuels, such as diesel fuel, or a volatile fuel such as DME or methane. It is understood that the closed circuit conduit may form a part of a closed crankcase ventilation system.

The invention was provided in view of the realization that, while there are known suggestions on how to handle crankcase gas during an operation of an engine, there is also a potential problem of fuel leakage into an engine crankcase at engine standstill. Said WO2010147132 does not address this problem, but simply suggests that while the engine is stopped, the crankcase gas conduit, leading to the air inlet, and the release line, leading to the atmosphere, are closed, and before a start-up of the engine, the air inlet crankcase gas conduit is closed, and the atmosphere release line is opened.

If a leakage of volatile fuel into crankcase occurs in a stopped engine, startability issues may arise. Also fuel vapor, such as DME vapor, could flow out to the ambient environment, which may result in a risk of fire or explosion, in particular if the engine is provided in vehicle which is parked indoors.

By the gas detection means in the air inlet guide, it is possible to detect a crankcase gas leak at a standstill mode of the engine. The location of the gas detection means is advantageous, since the air inlet provides a clean environment avoiding the risk of fouling of sensors of the gas detection means. For example, locating the gas detection means in the crankcase, may result in a risk of fouling of sensors of the gas detection means due to the harsh environment in the crankcase.

Further, the crankcase gas is not vented to ambient directly but is instead transported to the air inlet guide, e.g. at an inlet of a turbo compressor of the engine. Thereby, if there is a leakage of blow-by gas into the crankcase, the gas would flow to the air inlet guide, and gradually fill up the inlet guide, e.g. moving towards an air filter and further on towards an intake end of the air inlet. This is particularly advantageous on heavy duty vehicles, such as trucks, where the intake end of the air inlet guide is located relatively high above ground level. Thereby, where the crankcase gas is heavier than air, the risk of high gas concentrations at the ground level can be reduced.

Thus, the invention provides reliable means of automatic monitoring and detecting of possible leakage of volatile fuel during engine standstill. In addition, the invention provides a way to reduce the risk of high gas concentrations externally of a vehicle equipped with the engine, in case of a crankcase gas leakage at standstill.

Preferably, where the closed circuit conduit is arranged to guide the crankcase gas to a location of a connection of the closed circuit conduit to the air inlet guide, the gas detection means is positioned upstream of the connection location. Thereby, the risk of fouling of the gas sensors, by crankcase gas delivered by the closed circuit conduit during operation of the engine, is reduced or eliminated.

Preferably, the system comprises blocking means for at least partially blocking the air inlet guide, downstream of the connection location and upstream of the cylinder. It is understood that the blocking means may be arranged for at least partially blocking a gas flow path in the air inlet guide. Where the engine is provided with a compressor in the air inlet guide, the blocking means is preferably located downstream of the compressor. However, it could also be located upstream of the compressor.

Thereby, it is secured that crankcase gas reaching the air inlet guide during an engine standstill will not reach the cylinders, and an exhaust system downstream of the cylinders. Instead crankcase gas may be forced to an intake end of the air inlet guide. This may be particularly beneficial where advantage can be taken of a relatively high location of the intake end, as exemplified below. Also, the crankcase gas may be forced towards gas detection means positioned in the air inlet guide.

Herein, the upstream direction in the air inlet guide is understood as a direction with is opposite to a flow of air in the air inlet at a normal operation of the engine.

Preferably, the air inlet guide presents an intake end upstream of the gas detection means, and an intake portion extending from the intake end to the gas detection means, the system being arranged so that, in the mounted condition of the system, at least a part of the intake portion is located above the gas detection means. Thereby, since the density of crankcase gas is usually higher than that of air, it is secured that at a leakage, gas will reach the gas detection means before it reaches the atmosphere. Thereby, appropriate measures may be taken, as exemplified below, in view of risks caused by the gas reaching the atmosphere. It is understood that the intake end may be positioned above the gas detection means. In some embodiments, the intake portion may present a bend, whereby a part of the intake portion is located above the gas detection means, although the intake end is positioned below the gas detection means.

Preferably, the system is arranged so that, in the mounted condition of the system, the gas detection means is upstream of fuel supply means for supplying fuel to the cylinder. The fuel supply means may be arranged to inject fuel directly into the cylinder, and/or into the air inlet guide. The gas detection means being upstream of fuel supply means secured that the gas detection means are not fouled by fuel components.

Preferably, the gas detection means comprises a plurality of gas sensors. The gas detection means may comprise e.g. at least two gas sensors. The gas sensors may be of any type suitable to detect fuel vapors. The gas sensors may for example be distributed along at least a portion of the air inlet guide. Thereby, the gas sensors may be distributed along a path of a flow of air in the air inlet guide during normal operation of the engine. This provides for accurately determining a rate of a crankcase gas leakage, as exemplified below.

Preferably, the system comprises an open circuit conduit for guiding crankcase gas from the crankcase to the atmosphere, and a valve arrangement, adapted to selectively guide the crankcase gas to the closed circuit conduit or the open circuit conduit. Thereby, during a running mode of the engine, the valve arrangement may be adjusted to guide the crankcase gas to the closed circuit conduit. Thus, any crankcase gas leakage may the burned off in the cylinder, and its escape to the atmosphere is prevented. Also, when the engine is stopped, the valve arrangement may be adjusted so as to guide crankcase gas to the open circuit conduit. This may reduce the time it takes for the engine to stop upon an engine shut-off control action by a driver of a vehicle in which the engine is installed. When the engine stopping procedure is finalized, and the engine has reached a standstill mode, the valve arrangement may be adjusted so as to guide the crankcase gas to the closed circuit conduit.

The object is also reached with a system for ventilation of a crankcase of an internal combustion engine, the system comprising an open circuit conduit for guiding crankcase gas from the crankcase to the atmosphere, wherein the system comprises gas detection means positioned in the open circuit conduit, for detecting crankcase gas in the open circuit conduit.

Thereby, the gas detection means may be used for detecting the crankcase gas in the open circuit conduit in a standstill mode of the engine.

Thereby, similarly to what has been discussed above, the potential problem of fuel leakage into an engine crankcase at engine standstill may be handled efficiently. By the gas detection means in the open circuit conduit, it is possible to detect a crankcase gas leak at a standstill mode of the engine. The location of the gas detection means is advantageous, in particular where a closed circuit conduit is provided, since the open circuit conduit may only rarely guide dirty blow-by gas, providing a clean environment and avoiding the risk of fouling of sensors of the gas detection means. Thus, reliable means are provided for monitoring and detecting possible leakages of volatile fuel during engine standstill.

Preferably, the open circuit conduit presents an outlet end downstream of the gas detection means, and an outlet portion extending from the gas detection means to the outlet end, the system being arranged so that, in the mounted condition of the system, at least a part of the outlet portion is located above the gas detection means. Similarly to what has been discussed above regarding another embodiment, since the density of crankcase gas is usually higher than that of air, it is secured that at a leakage, gas will reach the gas detection means before it reaches the atmosphere.

Preferably, the system is adapted so that, in the mounted condition of the system, at least a portion of the open circuit conduit is located above at least one cylinder of the engine. The system may be adapted so that, in the mounted condition of the system, an outlet end of the open circuit conduit is located above at least one cylinder of the engine. Thereby, where the engine is installed in a vehicle, in particular a heavy duty vehicle, such as a truck, the outlet end would be at a relatively high location above the ground. Where the crankcase gas is heavier than air, a high level position of the outlet will reduce the risk of a high concentration of the crankcase gas at ground level. The system may be adapted so that, in the mounted condition of the system in a vehicle, an outlet end of the open circuit conduit is located at least 1 meter, preferably at least 2 or even at least 3 meters, above the ground. In some embodiments, the system may be adapted so that, in the mounted condition of the system in a vehicle, an outlet end of the open circuit conduit is located above the highest point of the engine. A high position of the outlet end will contribute to keeping it far away from areas where an open flame may be used, e.g. due to a person smoking. Also, a dissipation of crankcase gas across larger areas would be promoted by the high position of the outlet, resulting in a lower risk of the gas reaching the LEL (Lower Explosive Limit) at the ground level.

Preferably, where the system comprises an air inlet guide adapted to guide air to at least one cylinder of the engine, and a closed circuit conduit for guiding crankcase gas from the crankcase to the air inlet guide, a valve arrangement is provided, adapted to selectively guide the crankcase gas to the closed circuit conduit or the open circuit conduit. As also suggested above, thereby, during a running mode of the engine, the valve arrangement may be adjusted to guide the crankcase gas to the closed circuit conduit. Thus, any combustible crankcase gas leakage may the burned off in the cylinder, and its escape to the atmosphere is prevented. Also, during a running mode of the engine, the valve arrangement may be adjusted so as to guide crankcase gas to the open circuit conduit. Thereby, a crankcase gas leakage may be detected while the engine is running. Also, when the engine is stopped, the valve arrangement may be adjusted so as to guide crankcase gas to the open circuit conduit. This may reduce the time it takes for the engine to stop upon an engine shut-off control action by a driver of a vehicle in which the engine is installed.

Preferably, the gas detection means comprises a plurality of gas sensors. The gas sensors may be distributed along at least a portion of the open circuit conduit. Thereby, a determination of a crankcase gas leakage characteristic may be done with a high level of accuracy, as described closer below.

An aspect of the invention provides a system for ventilation of a crankcase of an internal combustion engine, the system comprising a passage for guiding crankcase gas from the crankcase to the atmosphere, wherein the system comprises a plurality of gas sensors. The gas sensors may be distributed along at least a portion of the passage. Thereby, a determination of a crankcase gas leakage characteristic may be done with a high level of accuracy, as described closer below.

An aspect of the invention provides a system for ventilation of a crankcase of an internal combustion engine, the system comprising an open circuit conduit for guiding crankcase gas from the crankcase to the atmosphere, wherein the system is adapted so that, in the mounted condition of the system, at least a portion of the open circuit conduit is located above at least one cylinder of the engine. Advantages of such a location of at least a portion of the open circuit conduit have been suggested above.

The object is also reached with an engine according to claim 15, or a vehicle according to claim 16.

The object is also reached with a method for controlling an internal combustion engine provided with a system for ventilation of a crankcase of the engine, the system comprising an air inlet guide adapted to guide air to at least one cylinder of the engine, a closed circuit conduit for guiding crankcase gas from the crankcase to a location of a connection of the closed circuit conduit to the air inlet guide, gas detection means positioned in the air inlet guide, upstream of the connection location, for detecting the crankcase gas in the air inlet guide, the method comprising at least partially blocking the air inlet guide, downstream of the connection location and upstream of the cylinder, during a standstill mode of the engine. Advantages of such a blockage of the air inlet guide have been suggested above.

An aspect of the invention provides a method for controlling an internal combustion engine provided with a system for ventilation of a crankcase of the engine, the system comprising an air inlet guide adapted to guide air to at least one cylinder of the engine, a closed circuit conduit for guiding crankcase gas from the crankcase to the air inlet guide, an open circuit conduit for guiding crankcase gas from the crankcase to the atmosphere, gas detection means positioned in the open circuit conduit for detecting crankcase gas in the open circuit conduit, and a valve arrangement adapted to selectively guide the crankcase gas to the closed circuit conduit or the open circuit conduit, the method comprising controlling the valve arrangement so as to guide crankcase gas to the closed circuit conduit in a running mode of the engine, and controlling the valve arrangement so as to guide crankcase gas to the open circuit conduit in a standstill mode of the engine.

As suggested above, thereby, during a running mode of the engine, the crankcase gas may the burned off in the cylinder, and its escape to the atmosphere is prevented. Controlling the valve arrangement so as to guide crankcase gas to the open circuit conduit in a standstill mode of the engine, allows for a reliable gas leakage detection with gas detection means in the open circuit conduit, as exemplified above. Further, at a crankcase gas leakage at standstill, the air inlet guide may be kept free from crankcase gas, so that the engine could be started without the risk of knocking.

An aspect of the invention provides a method for a system for ventilation of a crankcase of an internal combustion engine, the system comprising a passage for guiding crankcase gas from the crankcase to the atmosphere, and gas detection means positioned in the passage, the method comprising determining, at least partly based on signals from the gas detection means, a characteristic of a leak of crankcase gas to the passage.

The passage may be formed by a closed circuit conduit and an air inlet guide, as described above. In some embodiments, the passage may be formed by an open circuit conduit, as described above. The gas detection means may comprise a plurality of gas sensors distributed along at least a portion of the passage, the method comprising comparing the signals from the gas sensors, and determining the crankcase gas leak characteristic at least partly based on the comparison. The crankcase gas leak characteristic may be a leakage rate of the crankcase gas leak. Thereby, an assessment of the severity of the gas leak may be performed. Determining the crankcase gas leak characteristic may comprise determining a history of the crankcase gas leak. For example, based on the geometry of the air inlet guide at the gas sensors, and time differences between signals, indicating the presence of crankcase gas, provided from the sensors distributed along the air inlet guide, the leakage rate may be determined. Thereby, an accurate, simple and reliable manner of determining the gas leakage rate is provided.

Determining the leakage rate makes it possible to estimate the amount of crankcase gas that has escaped the crankcase. Additional factors taken into account for determining the leakage rate may include the ambient temperature, and the fuel pressure in the fuel system. For example, fuel escaping from a known volume would reduce pressure in the volume due to fuel compressibility effects, and the leakage rate determination may include relating the pressure difference to the quantity of fuel removed.

In some embodiments, the crankcase gas leak characteristic, e.g. the crankcase gas leakage rate, is determined based partly on a volume of the passage between the crankcase and the gas detection means. For example, the leakage rate may be determined based at least partly on a time duration from a commencement of an engine standstill mode to a detection of crankcase gas by the gas detection means. From this time duration, and the volume of the passage between the crankcase and the gas detection means, the leakage rate can be determined. Thereby, a simple and reliable manner of determining the gas leakage rate is provided.

Preferably, the method comprises determining, at least partly based on signals from the gas detection means, the presence of a leak of crankcase gas from the crankcase during a standstill mode of the engine, and introducing, in dependence on the crankcase gas leak presence determination, a restriction on the operation of the engine. Such a restriction may be introduced e.g. at an engine running mode following immediately upon the standstill mode. The engine operation restriction may comprise preventing, at least temporarily, a start of the engine running mode. Thereby, risks caused by the crankcase gas leakage may be mitigated.

The engine operation restriction may comprise a limitation of the engine speed at engine cranking at the end of the standstill mode. Thereby, where the passage comprises an air inlet guide of the engine, it is possible to pump crankcase gas in the air inlet guide through the engine, without reaching ignition temperature prior to normal cranking and start.

In some embodiments, the engine operation restriction comprises cranking the engine backwards at the end of the standstill mode. Thereby, at flow in the upstream direction of the air inlet guide may be created. Thus, crankcase gas present in the air inlet guide may be expelled from the air inlet guide before the engine is started, reducing the risk of the crankcase gas interfering with the engine operation, e.g. by causing knocking.

Preferably, the method comprises determining, at least partly based on signals from the gas detection means, the presence of a leak of crankcase gas from the crankcase during a standstill mode of the engine, and providing, in dependence on the crankcase gas leak presence determination, safety related data. For example, where the passage comprises an air inlet guide for the engine, the safety related data may comprise an expected engine speed upon an end of the standstill mode, e.g. the maximum peak engine speed that can be expected. The increased engine speed may be provided as a result of crankcase gas in the air inlet guide. Thereby, a basis is created for a determination on whether to introduce a restriction on the operation of the engine, as described above.

In some embodiments, the safety related data comprises an assessment of a need for ventilation in a vicinity of the engine. Upon determining such a need, an appropriate action for ventilation, e.g. of a closed space in which vehicle, in which the engine is installed, is parked, may be undertaken. For example, an automatic alert signal may be activated to prompt a person inside, or in the vicinity of, the vehicle, to take such an action.

The safety related data can alternatively, or in addition, form a basis for a number of additional diagnostic and safety functions, e.g. for determining the necessity and nature of troubleshooting before engine start.

The objects are also reached with a computer program according to claim 32, a computer readable medium according to claim 33, a control unit according to claim 34, and a vehicle according to claim 35.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
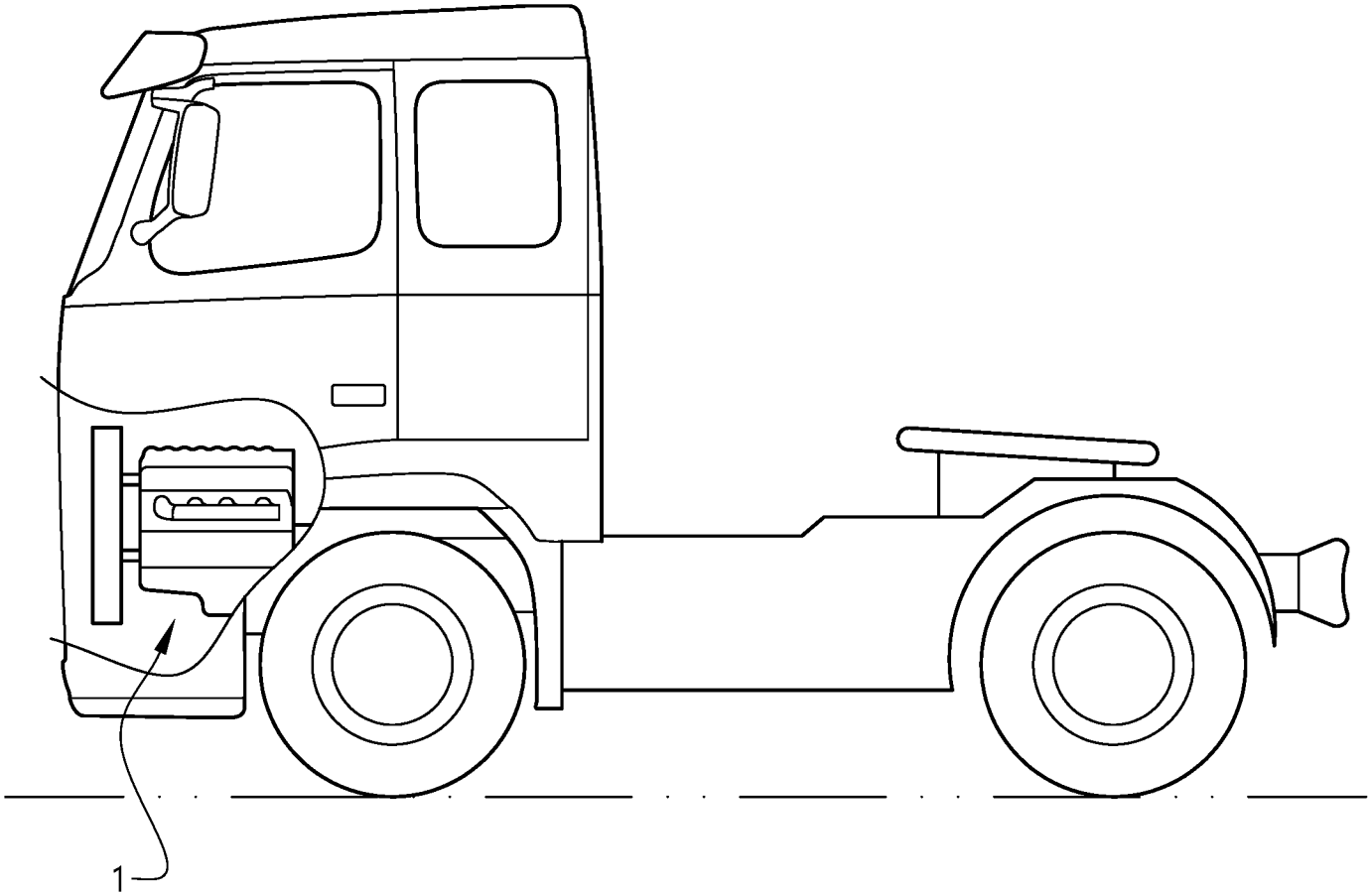
FIG. 1 is a side view of a vehicle in the form of a truck.

FIG. 1 shows a vehicle in the form of a truck, or a tractor for a semitrailer. It should be noted that the vehicle can be of a variety of alternative types, e.g. it may be a car, a bus, or a working machine such as a wheel loader. The vehicle comprises an internal combustion engine system with an internal combustion engine 1 with a plurality of cylinders. It should be noted that the invention is applicable to engines with any number of cylinders, even with a single cylinder. Also, the invention is applicable to engines with any cylinder configuration, e.g. an in-line configuration or a V-configuration.

Figure 2:
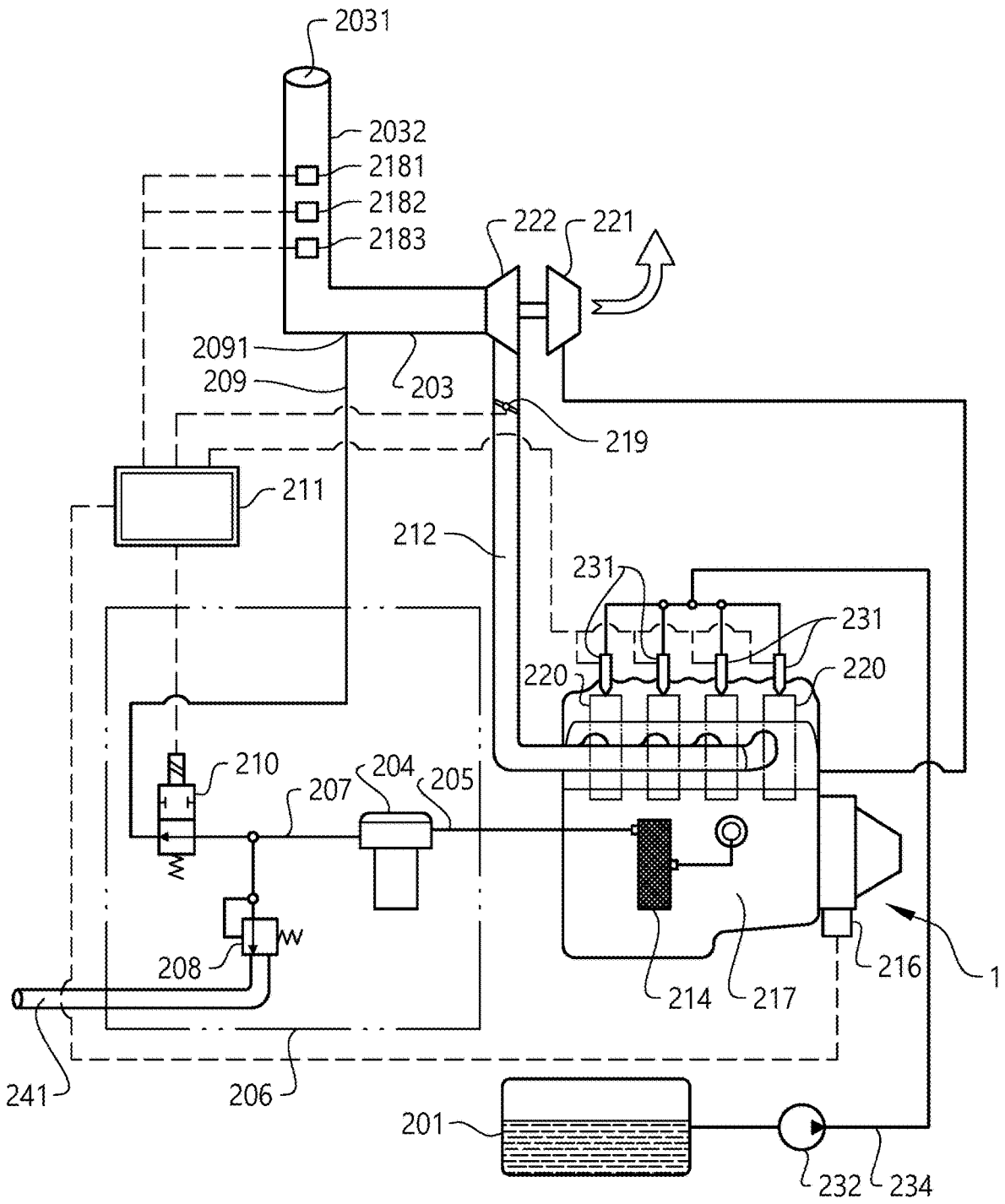
FIG. 2 is a schematic view of an engine system in the vehicle in FIG. 1.

Reference is made to FIG. 2, which illustrates an engine system according to an example embodiment of the present invention. The engine system comprises the internal combustion engine 1 which has a plurality of cylinders, in this example four cylinders 220 indicated with broken lines in FIG. 2, and a crankcase 217 housing a crankshaft (not shown) connected to pistons (not shown) in the cylinders 220 via respective connecting rods. The crankcase 217 is arranged to hold a hydrocarbon lubricant of a lubrication system of the engine 1 as is known per se. In this embodiment, the engine is a diesel engine, i.e. an engine adapted for a diesel cycle.

The engine system comprises a fuel container 201 for hydrocarbon fuel. In this embodiment the fuel container 201 is arranged to hold dimethyl ether (DME). However, in alternative embodiments the fuel container 201 may be arranged to contain any fuel that is suitable for the specific engine type. Hence, the fuel container 201 may be arranged to hold diesel fuel, liquefied natural gas (LNG), etc. It should be noted that the invention is equally applicable to engines adapted for an Otto cycle. Thereby, the fuel container may be arranged to hold fuel suitable for Otto engines, such as petrol or again LNG. The engine system further comprises an injector 231 at each cylinder. The injectors are herein also referred to as fuel supply means 231. The engine system further comprises, between the fuel container 201 and the injectors 231, a pump 232. The pump 232 is arranged to deliver fuel from the fuel container 201 to injectors 231, via a fuel conduit 234. The injectors 231 are arranged to be controlled by a control unit 211.

The engine system comprises a crankcase ventilation system 206, which will be described in detail below, and a turbo unit comprising a turbine 221 and a compressor 222. More specifically, a conduit 209, herein also referred to as a closed circuit conduit, connects the crankcase ventilation system 206 to an air intake 203 of the engine 1, upstream of the compressor 222. An intake manifold 212 is arranged to guide charge air from the compressor 222 to the cylinders of the engine 1. The air intake 203 and the intake manifold 212 are herein collectively referred to as an air inlet guide, an inlet guide, or a passage. The closed circuit conduit 209 is arranged to guide crankcase gas from the crankcase 217 to a location 2091 of a connection of the closed circuit conduit 209 to the air intake 203.

The crankcase ventilation system 206 in the non-limiting example depicted in FIG. 2 is similar to a system described in WO2015124160A1, incorporated herein by reference. The crankcase ventilation system 206 comprises an oil mist separator 204, and a valve arrangement. The valve arrangement comprises a relief valve 208, and a control valve 210 electrically connected to the control unit 211. The oil mist separator 204 is connected to an oil trap 214 via a crankcase path 205. The oil trap 214 is connected to the crankcase 217. Thus, the oil mist separator 204 is arranged downstream of the crankcase 217 and is arranged to receive a fluid from the crankcase. The oil mist separator 204 is adapted to separate oil from the fluid received from the crankcase 217, and provides a return path (not shown) to the crankcase 217 for the separated oil.

The relief valve 208 is arranged downstream the oil mist separator 204 and is arranged to be in fluid communication with the oil mist separator 204. The relief valve 208 is arranged to enter into a state in which a communication is provided between the oil mist separator 204 and an ambient environment of the engine 1, i.e. the atmosphere, when relief valve 208 is exposed to a pressure exceeding a predefined pressure limit. A passage in the form of an open circuit conduit 241, for guiding crankcase gas from the crankcase 217 to the atmosphere, extends from the relief valve.

The control valve 210 is arranged downstream the oil mist separator 204 and the relief valve 208. The control valve 210 is arranged to selectively, by control of the control unit 211, provide a fluid communication between the oil mist separator 204 and the intake 203 of the engine 1. The control valve 210 may, for example, be a two-way valve.

When there is fluid leakage formed in the crankcase 217 from e.g. the combustion process of the internal combustion engine, this crankcase fluid leakage is directed out from the crankcase through the crankcase path 205 and directed into the oil mist separator 204. In the oil mist separator 204 the leaked crankcase fluid is subjected to a separation process such that the fluid leaving the oil mist separator 204 is free, or relatively free, from particles that may negatively affect the environment.

When the control valve 210 is open, the fluid may be transported from the crankcase 217 via the oil mist separator 204 to the air intake 203. Thereby the crankcase ventilation system 206 is in what is herein referred to as a closed condition. By closing the control valve 210, such a transportation is prevented. Thereby the crankcase ventilation system 206 is in what is herein referred to as an open condition. In the open condition, a pressure might build up upstream of the relief valve 208. When such a pressure builds up and exceeds the predefined pressure limit, the relief valve 208 opens so as to allow the fluid from the oil mist separator 204 to be released to the atmosphere. Thus, the valve arrangement 208, 210 is adapted to selectively guide the crankcase gas to the closed circuit conduit 209 or the open circuit conduit 241.

Other valve arrangements are possible for the crankcase ventilation system 206. For example, the relief valve 208 and the control valve 210 may be replaced by a single valve controllable by the control unit 211 so as to selectively provide a communication between the oil mist separator 204 and the air intake 203 and a communication between the oil mist separator 204 and the atmosphere.

The control unit 211 is also arranged to receive signals from a rotational speed sensor 216 arranged to detect the rotational speed of the engine 1.

The air intake 203 presents an intake end 2031 at which air enters the air intake during operation of the engine 1. Herein, an upstream direction in the air intake 203 is defined as a direction from the compressor 222 to the intake end 2031, i.e. opposite to the air flow direction during operation of the engine.

The control unit 211 is arranged to receive signals from gas detection means 2181, 2182, 2183 positioned in the air intake 203, upstream of the connection location 2091. The gas detection means comprises a plurality of, in this embodiment three gas sensors 2181, 2182, 2183, distributed along a portion of the air inlet guide 203, 212. The gas detection means 2181, 2182, 2183 is arranged to detect crankcase gas in the air intake 203, in particular when the vehicle is parked, the engine is shut down, and there is not suction of air towards the compressor 222. It should be noted that the number of gas sensors may vary between different embodiments; i.e. instead of three gas sensor, there may be only one gas sensor, or two, four, or more gas sensors. By being distributed along a portion of the air inlet guide 203, 212, the gas sensors are distributed in an intended direction of an air flow in the air inlet guide. Instead of being distributed along a portion of the air inlet guide 203, 212, the gas sensors may be arranged in some other way, e.g. transversely to the intended direction of an air flow in the air inlet guide.

The location of the gas detection means 2181, 2182, 2183 may in some embodiments differ from what is described here with reference to FIG. 2. The gas detection means is preferably located upstream of the connection location 2091, but may in some embodiments be located downstream of the connection location 2091. The gas detection means is preferably located upstream of the compressor 222. The gas detection means is preferably, e.g. in embodiments where the engine is not provided with a compressor 222, located upstream of any fuel injector, that may e.g. be arranged to inject fuel into the intake manifold 212, as opposed to into the cylinders.

The intake end 2031 is located upstream of the gas detection means 2181, 2182, 2183. An intake portion 2032 extends from the intake end 2031 to the gas detection means 2181, 2182, 2183. The system is arranged so that, in the mounted condition of the system, the intake portion 2032, or at least a part thereof, is located above the gas detection means 2181, 2182, 2183. I.e., when the vehicle is standing on a horizontal piece of ground, the intake portion 2032, or at least a part thereof, is more elevated than the gas detection means 2181, 2182, 2183. In some embodiments, the intake end 2031 may be below the gas detection means 2181, 2182, 2183, but a part of the intake portion 2032 may still be located above the gas detection means 2181, 2182, 2183.

The system comprises blocking means 219 for blocking the air inlet guide 203, 212, downstream of the connection location 2091 and upstream of the cylinders 220. The blocking means 219 is controllable by the control unit 211. In this embodiment blocking means 219 is provided in the form a throttle valve. As will be described below, the blocking means 219 is closed when the engine is shut down. The throttle valve could be a valve used for controlling the supply of air to the cylinders during engine operation.

Figure 3:
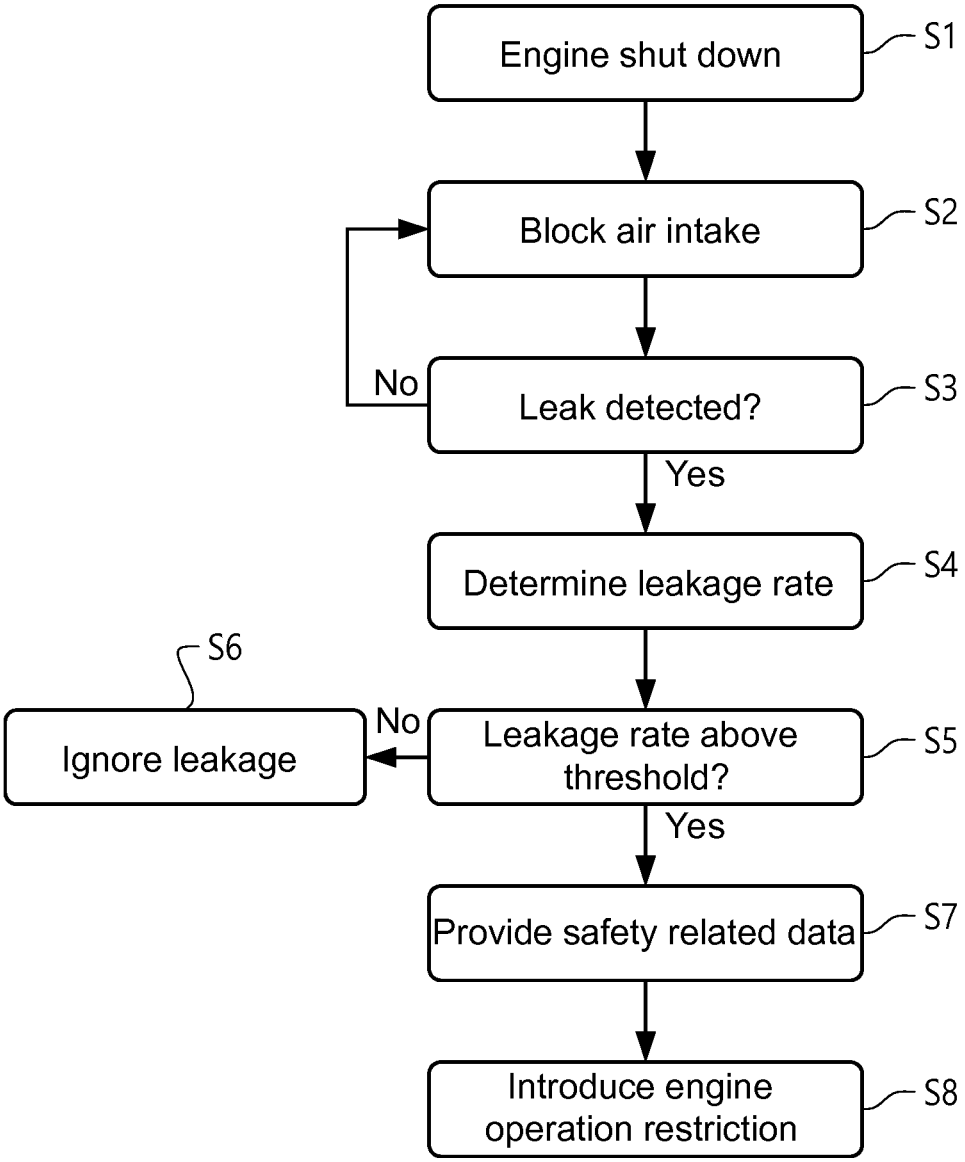
FIG. 3 is a block diagram depicting steps in a method of controlling the system in FIG. 2.

FIG. 3 is a block diagram depicting steps in a method according to an embodiment of the method.

The method is initiated when the engine 1 is shut off S1. Thereby the engine enters what is herein referred to as a standstill mode. The engine shut down may be done upon the vehicle being parked. Upon the engine shut down, the blocking means 219 is controlled so as to block S2 the air intake 203 downstream of the connection location 2091.

Thereupon, the control unit 211 continuously determines, based on signals from the gas detection means 2181, 2182, 2183, whether there is a leak of crankcase gas to the air intake 203.

If a leak is detected, a characteristic of the leak is determined. This involves determining S4 a rate of the leak. More specifically, the flow of crankcase gas from the crankcase 217 is determined. Determining the rate of the leak involves determining a history of the crankcase gas leak. Thereby, the leakage rate is determined based on the history of signals from the gas sensors 2181, 2182, 2183 distributed along the air intake. More specifically, based on the geometry of the air intake 203 around the gas sensors, and time differences between signals, indicating the presence of crankcase gas, provided from the sensors distributed along the air intake, the leakage rate is determined. The geometry of the air intake 203 around the gas sensors is predetermined and stored accessible to the control unit 211.

Alternatively or in addition, determining the leakage rate is done based partly on the combined volume of the closed circuit conduit 209 and the air intake 203, between the crankcase 217 and the gas detection means 2181, 2182, 2183. This volume is predetermined and stored accessible to the control unit 211. The leakage rate is determined based partly on a time duration from a commencement of an engine standstill mode to a detection of crankcase gas by the gas detection means 2181, 2182, 2183. From this time duration, and the combined volume of the closed circuit conduit and the air intake, the leakage rate can be determined.

The method comprises determining S5 whether the crankcase gas leakage rate is above a predetermined threshold. If the leakage rate is below the threshold, no further action is taken S6 in relation to the leakage. If the leakage rate is above the threshold, safety related data is provided S7 by the control unit 211. The safety related data comprises an expected engine behaviour upon an end of the standstill mode. The expected engine behaviour is determined based on the leakage rate and the volume of the air intake 203, giving an indication of the flow of combustible gas to the cylinders upon engine start. This indicates a surplus of hydrocarbon, in addition to what is supplied by the fuel injectors 231, to the cylinders, which indication can serve as a basis for the engine behaviour determination. The expected engine behaviour may include for example excessive knocking, or an excessive peak cylinder pressure, at the first firings at the engine start. The expected engine behaviour may alternatively or additionally include an expected engine speed, which e.g. may be excessive.

The safety related data also comprises an assessment, based on the leakage rate, of a need for ventilation in a vicinity of the engine. For example, if the leakage rate is above a predetermined level, an alert signal, which may indicate to a person, in the vehicle or in the vicinity of the vehicle, a need to ventilate a region around the vehicle, may be activated.

Also, if the leakage rate is above the threshold, a restriction on the operation of the engine is introduced S8. The engine operation restriction comprises preventing a start of the engine running mode. In some embodiments, the engine operation restriction comprises cranking the engine backwards at the end of the standstill mode, in order to create a flow in the upstream direction in the air intake 203, to remove the crankcase gas from the air intake 203. In some embodiments, the engine operation restriction comprises a limitation of the engine speed at engine cranking at the end of the standstill mode.

Figure 4:
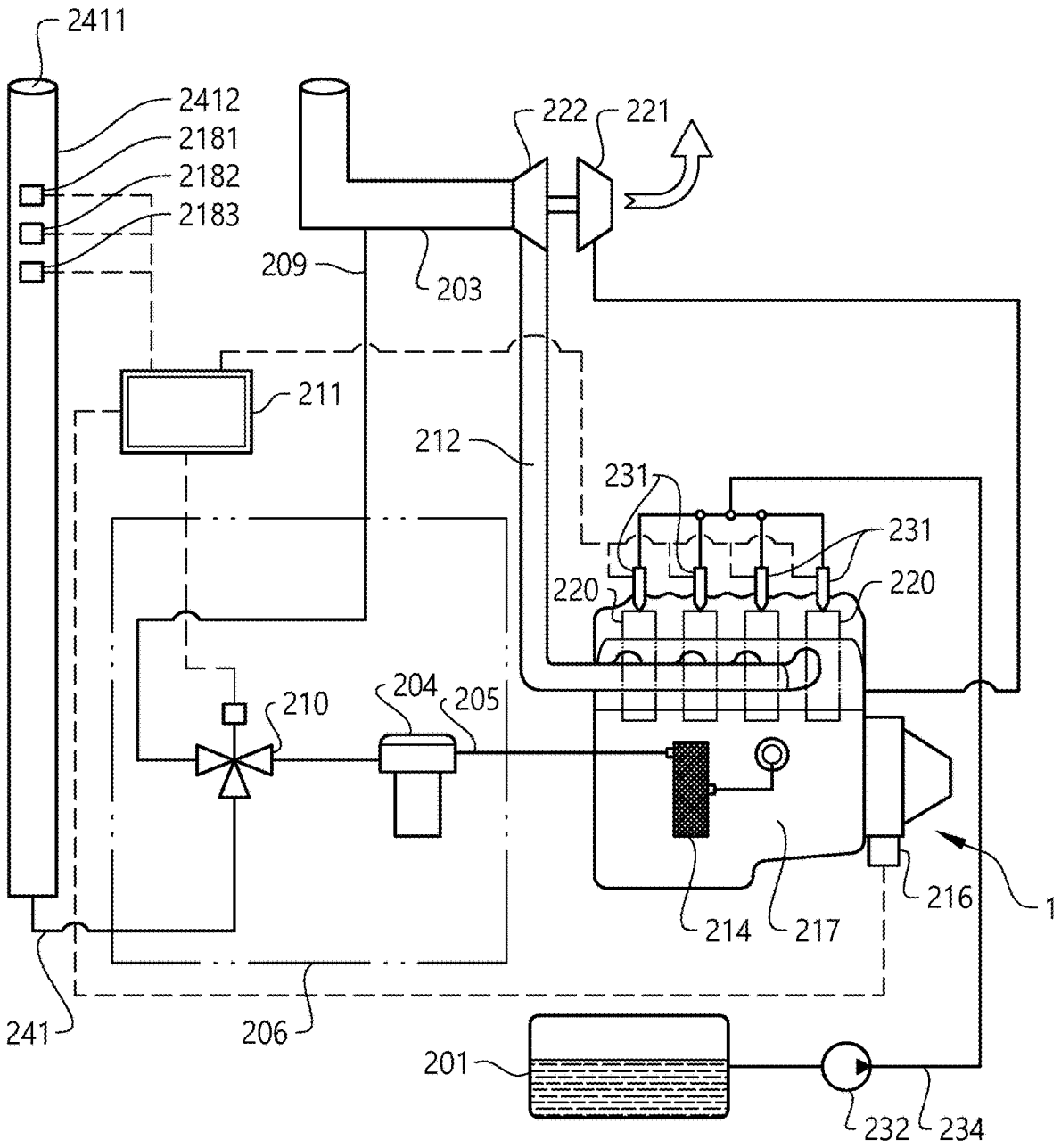
FIG. 4 is a schematic view of an engine system according to an alternative embodiment of the invention.

FIG. 4 shows an engine system according to an alternative embodiment of the invention. The system is similar to the system described with reference to FIG. 2, with some exceptions:

As in FIG. 2, the open circuit conduit 241 is arranged for guiding crankcase gas from the crankcase 217 to the atmosphere. Herein, a downstream direction in the open circuit conduit 241 is defined as a direction from the valve arrangement 208, 210 to an outlet end 2411 of the open circuit conduit 241, at which outlet end 2411 the open circuit conduit 241 communicates with the atmosphere.

The system comprises gas detection means 2181, 2182, 2183 positioned in the open circuit conduit 241, for detecting crankcase gas in the open circuit conduit 241. The gas detection means comprises three gas sensors 2181, 2182, 2183 distributed along a portion of the open circuit conduit 241. The outlet end 2411 is provided downstream of the gas detection means 2181, 2182, 2183. An outlet portion 2412 extends from the gas detection means 2181, 2182, 2183 to the outlet end 2411. The system is arranged so that, in the mounted condition of the system, the outlet portion 2412 is located above the gas detection means 2181, 2182, 2183. Further, the system is adapted so that, in the mounted condition of the system, a portion of the open circuit conduit 241 is located above the cylinders 220 of the engine.

The system comprises a valve arrangement 210, controllable by the control unit 211, and arranged to selectively guide crankcase gas to the closed circuit conduit 209, and to the open circuit conduit 241.

Figure 5:
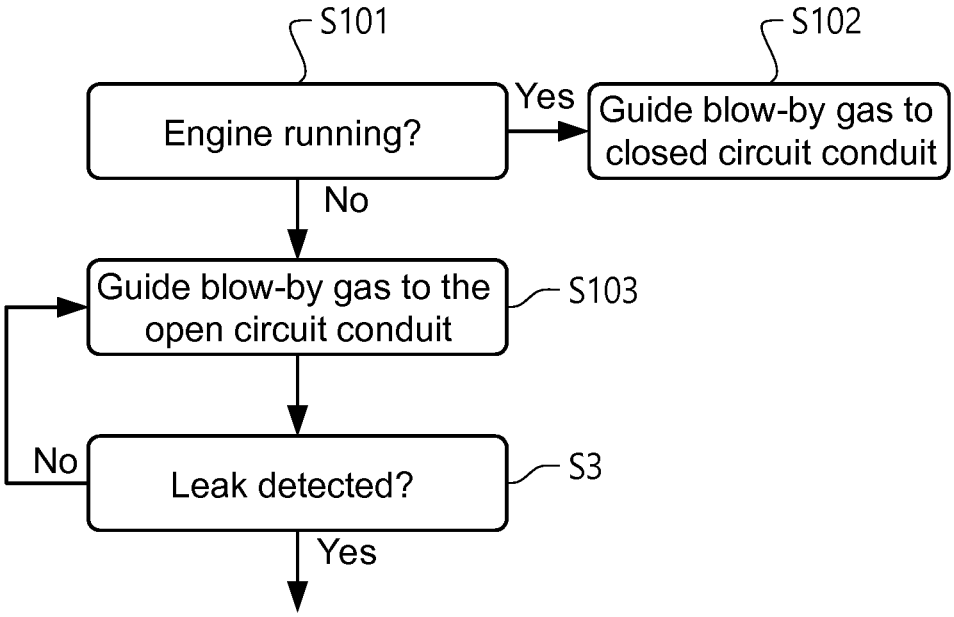
FIG. 5 is a block diagram depicting steps in a method of controlling the system in FIG. 4.

Reference is made to FIG. 5 depicting steps in a method of controlling the system in FIG. 4. The control unit 211 determines S101 whether the engine is in a running mode, i.e. whether the engine is running. In the engine running mode, the valve arrangement 210 is controlled so as to guide S102 crankcase gas to the closed circuit conduit 209. Upon shutting the engine down, so as to enter an engine standstill mode, the valve arrangement 210 is controlled so as to guide S103 crankcase gas to the open circuit conduit 241 in of the engine.

In the engine standstill mode, the steps S3-S8 in the method described above with reference to FIG. 3 may also be performed in the system described with reference to FIG. 5, with the only difference of the location of the gas detection means 2181, 2182, 2183.

It should be noted that the system may be provided without a capacity to change between guiding crankcase gas to a closed circuit conduit and an open circuit conduit. For example, the system may be provided without an open circuit conduit, with the only option to guide crankcase gas to a closed circuit conduit. The system may alternatively be provided without a closed circuit conduit, with the only option to guide crankcase gas to an open circuit conduit.

Figure 6:
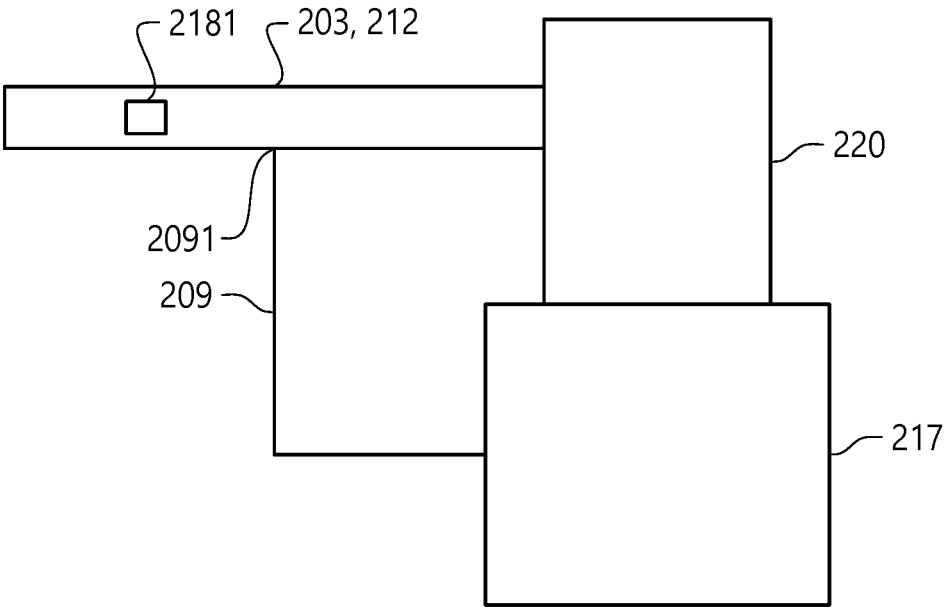
FIG. 6 is a schematic view of an engine system according to a further embodiment of the invention.

FIG. 6 shows a further embodiment of a system for ventilation of a crankcase 217 of an internal combustion engine. An air inlet guide 203, 212 is adapted to guide air to a cylinder 220 of the engine. A closed circuit conduit 209 is arranged to guide crankcase gas from the crankcase 217 to a location 2091 of a connection of the closed circuit conduit 209 to the air inlet guide 203, 212. The system comprises gas detection means 2181 positioned in the air inlet guide 203, 212, upstream of the connection location 2091, for detecting crankcase gas in the air inlet guide.

It is to be understood that the present invention is not limited to the embodiments described above and illustrated in the drawings; rather, the skilled person will recognize that many changes and modifications may be made within the scope of the appended claims.

The invention claimed is:

1. A system for ventilation of a crankcase of an internal combustion engine, the system comprising:

an air inlet guide adapted to guide air to at least one cylinder of the engine, a closed circuit conduit for guiding crankcase gas from the crankcase to the air inlet guide, at least one gas sensor positioned in the air inlet guide, for detecting crankcase gas in the air inlet guide, and wherein the closed circuit conduit is arranged to guide the crankcase gas to a location of a connection of the closed circuit conduit to the air inlet guide, the at least one gas sensor being positioned either upstream and outside of an intended direction of a crankcase gas flow in the air inlet guide during engine operation or upstream of any crankcase gas connection location.

2. A system according to claim 1, characterized in that the system comprises blocking means for at least partially blocking the air inlet guide, downstream of the connection location and upstream of the cylinder.

3. A system according to claim 1, characterized in that the air inlet guide presents an intake end upstream of at least one gas sensor, and an intake portion extending from the intake end to at least one gas sensor, the system being arranged so that, in the mounted condition of the system, at least a part of the intake portion is located above at least one gas sensor.

4. A system according to claim 1, characterized in that the system is arranged so that, in the mounted condition of the system, at least one gas sensor is upstream of fuel supply means for supplying fuel to the cylinder.

5. A system according to claim 1, characterized in that at least one gas sensor comprises a plurality of gas sensors.

6. A system according to claim 1, characterized in that the system comprises an open circuit conduit for guiding crankcase gas from the crankcase to the atmosphere, and a valve arrangement, adapted to selectively guide the crankcase gas to the closed circuit conduit or the open circuit conduit.

7. An engine comprising a system according to claim 1.

8. A vehicle comprising an engine according to claim 7.

9. A system for ventilation of a crankcase of an internal combustion engine, the system comprising an open circuit conduit for guiding crankcase gas from the crankcase to the atmosphere, characterized in that the system comprises at least one gas sensor positioned in the open circuit conduit, for detecting crankcase gas in the open circuit conduit.

10. A system according to claim 9, characterized in that the open circuit conduit presents an outlet end downstream of at least one gas sensor, and an outlet portion extending from at least one gas sensor to the outlet end, the system being arranged so that, in the mounted condition of the system, at least a part of the outlet portion is located above at least one gas sensor.

11. A system according to claim 9, characterized in that the system is adapted so that, in the mounted condition of the system, at least a portion of the open circuit conduit is located above at least one cylinder of the engine.

12. A system according to claim 9, characterized in that the system comprises an air inlet guide adapted to guide air to at least one cylinder of the engine, a closed circuit conduit for guiding crankcase gas from the crankcase to the air inlet guide, and a valve arrangement adapted to selectively guide the crankcase gas to the closed circuit conduit or the open circuit conduit.

13. A system according to claim 9, characterized in that at least one gas sensor comprises a plurality of gas sensors.

14. A system for ventilation of a crankcase of an internal combustion engine, the system comprising a passage for guiding crankcase gas from the crankcase to the atmosphere, the passage including an air inlet guide adapted to guide air to at least one cylinder of the engine, a closed circuit conduit for guiding crankcase gas from the crankcase to the air inlet guide, and an open circuit conduit for guiding crankcase gas from the crankcase to the atmosphere, wherein the system comprises a plurality of gas sensors to detect, at standstill of the internal combustion engine, crankcase gas distributed along at least a portion of the passage in an intended direction of a crankcase gas flow in the passage, or transversely to the intended direction of a crankcase gas flow in the passage.

15. The system of claim 14, wherein the system is adapted so that, in the mounted condition of the system, at least a portion of the open circuit conduit is located above at least one cylinder of the engine.

16. A method for controlling an internal combustion engine provided with a system for ventilation of a crankcase of the engine, the system comprising an air inlet guide adapted to guide air to at least one cylinder of the engine, a closed circuit conduit for guiding crankcase gas from the crankcase to a location of a connection of the closed circuit conduit to the air inlet guide, at least one gas sensor being positioned either upstream and outside of an intended direction of a crankcase gas flow in the air inlet guide during engine operation or upstream of any crankcase gas connection location, upstream of the connection location, for detecting the crankcase gas in the air inlet guide, at least partially blocking the air inlet guide, downstream of the connection location and upstream of the cylinder, during a standstill mode of the engine.

17. A method according to claim 16, characterized by determining, at least partly based on signals from at least one gas sensor, the presence of a leak of crankcase gas from the crankcase during a standstill mode of the engine, and introducing, in dependence on the crankcase gas leak presence determination, a restriction on the operation of the engine.

18. A method according to claim 17, characterized in that the engine operation restriction comprises preventing, at least temporarily, a start of the engine running mode.

19. A method according to claim 17, characterized in that the engine operation restriction comprises a limitation of the engine speed at engine cranking at the end of the standstill mode.

20. A method according to claim 17, characterized in that the engine operation restriction comprises cranking the engine backwards at the end of the standstill mode.

21. A method according to claim 17, characterized by determining, at least partly based on signals from at least one gas sensor, the presence of a leak of crankcase gas from the crankcase during a standstill mode of the engine, and providing, in dependence on the crankcase gas leak presence determination, safety related data.

22. A method according to claim 21, characterized in that the safety related data comprises an expected engine speed upon an end of the standstill mode.

23. A method according to claim 21, characterized in that the safety related data comprises an assessment of a need for ventilation in a vicinity of the engine.

24. A computer readable medium carrying a computer program comprising program code means for performing the steps of claim 16 when said program product is run on a computer.

25. A control unit configured to perform the steps of the method according to claim 16.

26. A vehicle comprising a control unit according to claim 25.

27. A method for controlling an internal combustion engine provided with a system for ventilation of a crankcase of the engine, the system comprising an air inlet guide adapted to guide air to at least one cylinder of the engine, a closed circuit conduit for guiding crankcase gas from the crankcase to the air inlet guide, an open circuit conduit for guiding crankcase gas from the crankcase to the atmosphere, at least one gas sensor being positioned either upstream and outside of an intended direction of a crankcase gas flow in the air inlet guide during engine operation or upstream of any crankcase gas connection location in the open circuit conduit for detecting crankcase gas in the open circuit conduit, and a valve arrangement adapted to selectively guide the crankcase gas to the closed circuit conduit or the open circuit conduit, characterized by controlling the valve arrangement so as to guide crankcase gas to the closed circuit conduit in a running mode of the engine, and controlling the valve arrangement so as to guide crankcase gas to the open circuit conduit in a standstill mode of the engine.

28. A method for a system for ventilation of a crankcase of an internal combustion engine, the system comprising a passage for guiding crankcase gas from the crankcase to the atmosphere, a closed circuit conduit is arranged to guide the crankcase gas to a location of a connection of the closed circuit conduit to the air inlet guide, a plurality of gas sensors distributed along at least a portion of the passage in an intended direction of an air flow in the air inlet guide, or transversely to the intended direction of an air flow in the air inlet guide, characterized by comparing the signals from the gas sensors, and determining, at least partly based on signals from at least one gas sensor and at least partly based on the comparison, a characteristic of a leak of crankcase gas to the passage.

29. A method according to claim 28, characterized in that the crankcase gas leak characteristic is a leakage rate of the crankcase gas leak.

30. A method according to claim 28, characterized in that determining the crankcase gas leak characteristic comprises determining a history of the crankcase gas leak.

31. A method according to claim 28, characterized by determining the crankcase gas leak characteristic based partly on a volume of the passage between the crankcase and at least one gas sensor.

32. A method according to claim 28, characterized by determining the crankcase gas leak characteristic based partly on a time duration from a commencement of an engine standstill mode to a detection of crankcase gas by at least one gas sensor.

* * * * *